US008328123B2

(12) United States Patent
Evans et al.

(10) Patent No.: US 8,328,123 B2
(45) Date of Patent: Dec. 11, 2012

(54) VARIABLE BLOWING CONTROL SYSTEM FOR LOOSEFILL BLOWING MACHINE

(75) Inventors: Michael E. Evans, Granville, OH (US); Christopher M. Relyea, Columbus, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 286 days.

(21) Appl. No.: 12/888,446

(22) Filed: Sep. 23, 2010

(65) Prior Publication Data

US 2012/0074248 A1 Mar. 29, 2012

(51) Int. Cl.
*B02C 19/00* (2006.01)

(52) U.S. Cl. ..... 241/18; 241/60; 241/605

(58) Field of Classification Search ..... 241/18, 241/60, 605

See application file for complete search history.

(56) References Cited

U.S. PATENT DOCUMENTS 5,403,128 A 4/1995 Thomas
6,161,784 A * 12/2000 Horton ..... 239/654
6,503,026 B1 * 1/2003 Mitchell ..... 406/128
7,227,330 B2 6/2007 Swamy et al.
7,731,115 B2 6/2010 Johnson et al.
7,762,484 B2 7/2010 Johnson et al.
2004/0251344 A1 12/2004 Lutton et al.

* cited by examiner

*Primary Examiner* — Mark Rosenbaum
(74) *Attorney, Agent, or Firm* — MacMillan, Sobanski & Todd, LLC

(57) ABSTRACT

A machine for distributing loosefill insulation from sources of compressed loosefill insulation is provided. The machine includes a shredding chamber having an outlet end and a plurality of shredders configured to condition the loosefill insulation. The plurality of shredders is configured to operate at variable rotational speeds. A discharge mechanism is mounted at the outlet end of the shredding chamber. The discharge mechanism is configured for distributing the conditioned loosefill insulation into an airstream provided by a blower. The blower is configured to operate at variable rotational speeds. The plurality of shredders, the discharge mechanism and the blower are configured to operate on a single 15 ampere, 110 volt a.c. power supply. The variable rotational speeds of the plurality of shredders are configured to provide variable flow rates of the loosefill insulation and the variable rotational speeds of the blower are configured to provide variable flow rates of the airstream.

20 Claims, 6 Drawing Sheets

VARIABLE BLOWING CONTROL SYSTEM FOR LOOSEFILL BLOWING MACHINE

BACKGROUND

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the loosefill insulation into an insulation cavity, such as a wall cavity or an attic of a building. Typically loosefill insulation is made of glass fibers although other mineral fibers, organic fibers, and cellulose fibers can be used.

Loosefill insulation, also referred to as blowing wool, is typically compressed and encapsulated in a bag. The compressed loosefill insulation and the bag form a package. Packages of compressed loosefill insulation are used for transport from an insulation manufacturing site to a building that is to be insulated. The bags can be made of polypropylene or other suitable materials. During the packaging of the loosefill insulation, it is placed under compression for storage and transportation efficiencies. The compressed loosefill insulation can be packaged with a compression ratio of at least about 10:1. The distribution of loosefill insulation into an insulation cavity typically uses a loosefill blowing machine that feeds the loosefill insulation pneumatically through a distribution hose. Loosefill blowing machines can have a chute or hopper for containing and feeding the compressed loosefill insulation after the package is opened and the compressed loosefill insulation is allowed to expand.

It would be advantageous if the loosefill blowing machines could be easier to use.

SUMMARY

The above objects as well as other objects not specifically enumerated are achieved by a machine for distributing loosefill insulation from a source of compressed loosefill insulation. The machine is configured to discharge the loosefill insulation into distribution hoses. The machine includes a shredding chamber having an outlet end and a plurality of shredders configured to condition the loosefill insulation. The plurality of shredders is configured to operate at variable rotational speeds. A discharge mechanism is mounted at the outlet end of the shredding chamber. The discharge mechanism is configured for distributing the conditioned loosefill insulation from a machine outlet in an airstream provided by a blower. The blower is configured to operate at variable rotational speeds. The plurality of shredders, the discharge mechanism and the blower are configured to operate on a single 15 ampere, 110 volt a.c. power supply. The variable rotational speeds of the plurality of shredders are configured to provide variable flow rates of the loosefill insulation and the variable rotational speeds of the blower are configured to provide variable flow rates of the airstream.

According to this invention there is also provided a machine for distributing loosefill insulation from a source of compressed loosefill insulation. The machine is configured to discharge the loosefill insulation into distribution hoses. The machine includes an upper unit having an inlet and an outlet, the inlet configured to receive the compressed loosefill insulation. A lower unit has an inlets connected to the outlet of the upper unit. The lower unit further includes a shredding chamber, a discharge mechanism, a blower and a motor. The shredding chamber has a plurality of shredders configured to condition the loosefill insulation. The plurality of shredders is configured to operate at variable rotational speeds. The discharge mechanism is configured for distributing the conditioned loosefill insulation from a machine outlet in an airstream provided by the blower. The blower is configured to operate at variable rotational speeds. The plurality of shredders, the discharge mechanism and the blower are driven by the motor configured to operate on a single 15 ampere, 110 volt a.c. power supply. The variable rotational speeds of the plurality of shredders are configured to provide variable flow rates of the loosefill insulation and the variable rotational speeds of the blower are configured to provide variable flow rates of the airstream.

According to this invention there is also provided a method of distributing loosefill insulation from a machine for distributing loosefill insulation from a package of compressed loosefill insulation. The method includes the steps of providing a shredding chamber having an outlet end and a plurality of shredders configured to condition the loosefill insulation, the plurality of shredders configured to operate at variable rotational speeds, providing a discharge mechanism mounted at the outlet end of the shredding chamber, the discharge mechanism configured for distributing the conditioned loosefill insulation from a machine outlet in an airstream provided by a blower, the blower configured to operate at variable rotational speeds, operating the plurality of shredders, the discharge mechanism and the blower on a single 15 ampere, 110 volt a.c. power supply, varying the rotational speed of the plurality of shredders such as to provide variable flow rates of the loosefill insulation and varying the rotational speed of the blower such as to provide variable flow rates of the airstream.

Various objects and advantages of this invention will become apparent to those skilled in the art from the following detailed description of the preferred embodiment, when read in light of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, the description and figures disclose variable blowing control systems for loosefill blowing machines. The term "variable", as used herein, is defined to mean changeable from one level to another level. The term "control system", as used herein, is defined to mean a component or group of components configured to manipulate the operation of other components or systems within the loosefill blowing machine. The term "loosefill insulation", as used herein, is defined to any insulation materials configured for distribution in an airstream. The term "finely condition", as used herein, is defined to mean the shredding of loosefill insulation to a desired density prior to distribution into an airstream.

Figure 1:
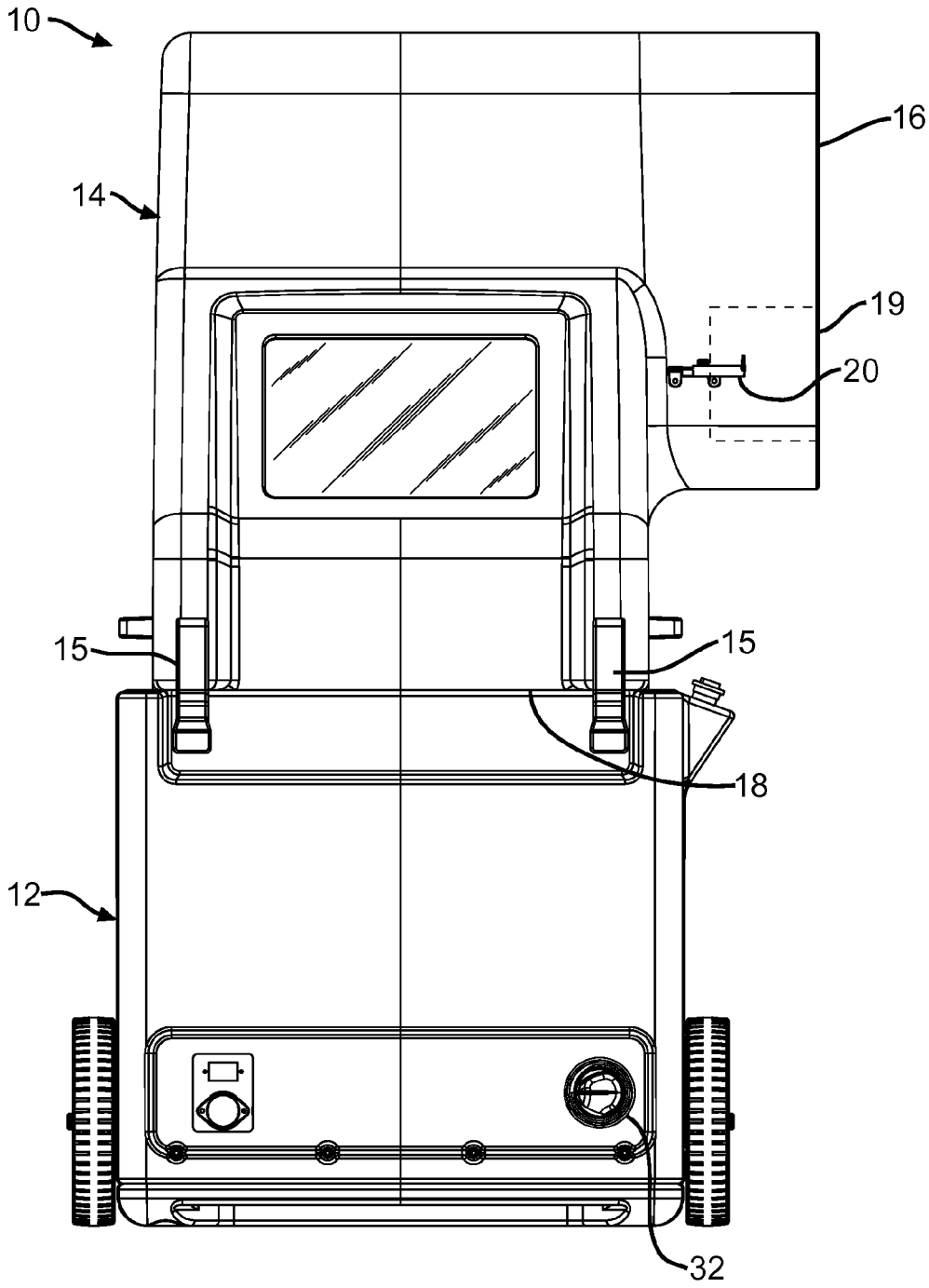
FIG. 1 is a front view in elevation of a loosefill blowing machine.
Figure 2:
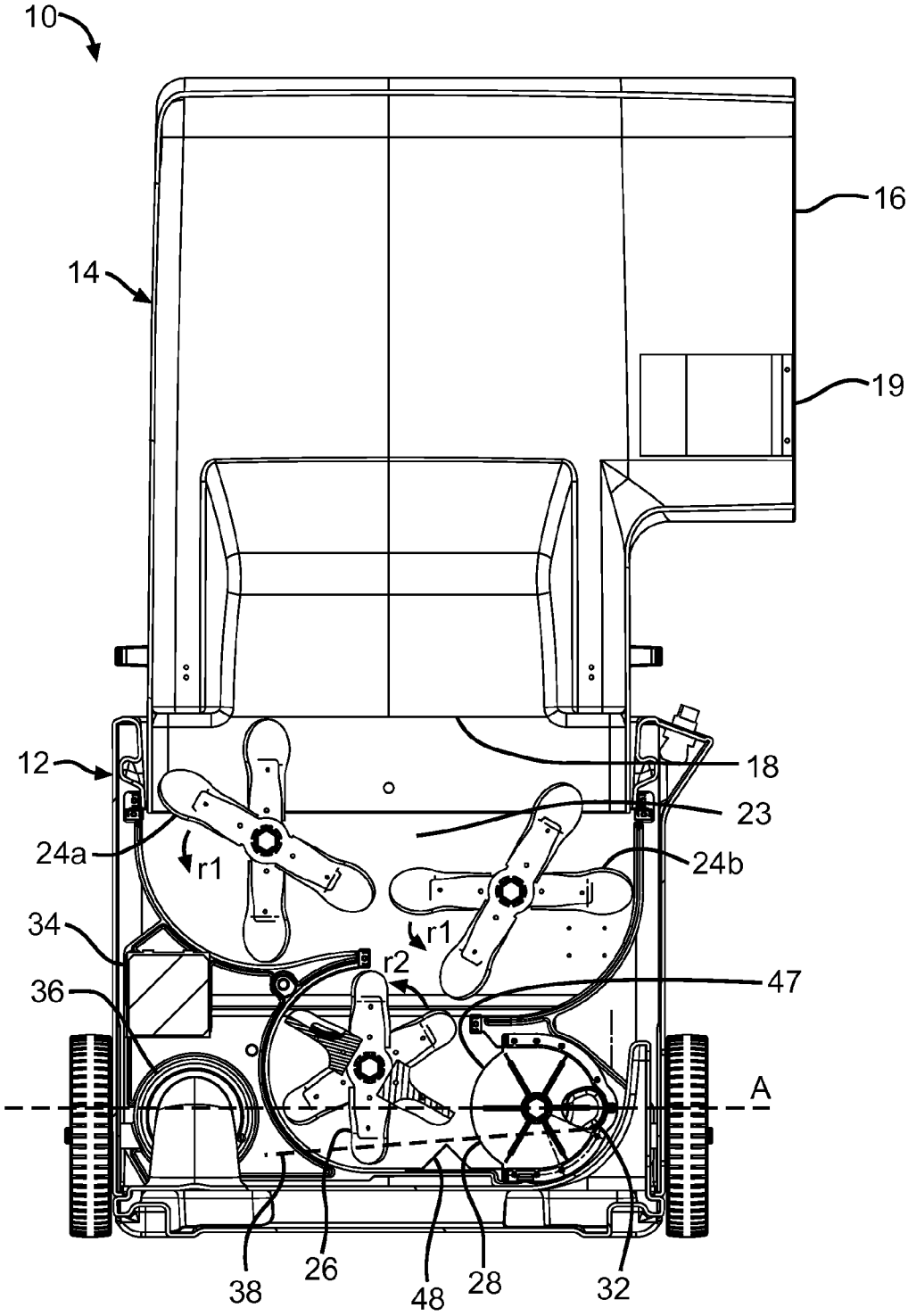
FIG. 2 is a front view in elevation, partially in cross-section, of the loosefill blowing machine of FIG. 1.
Figure 3:
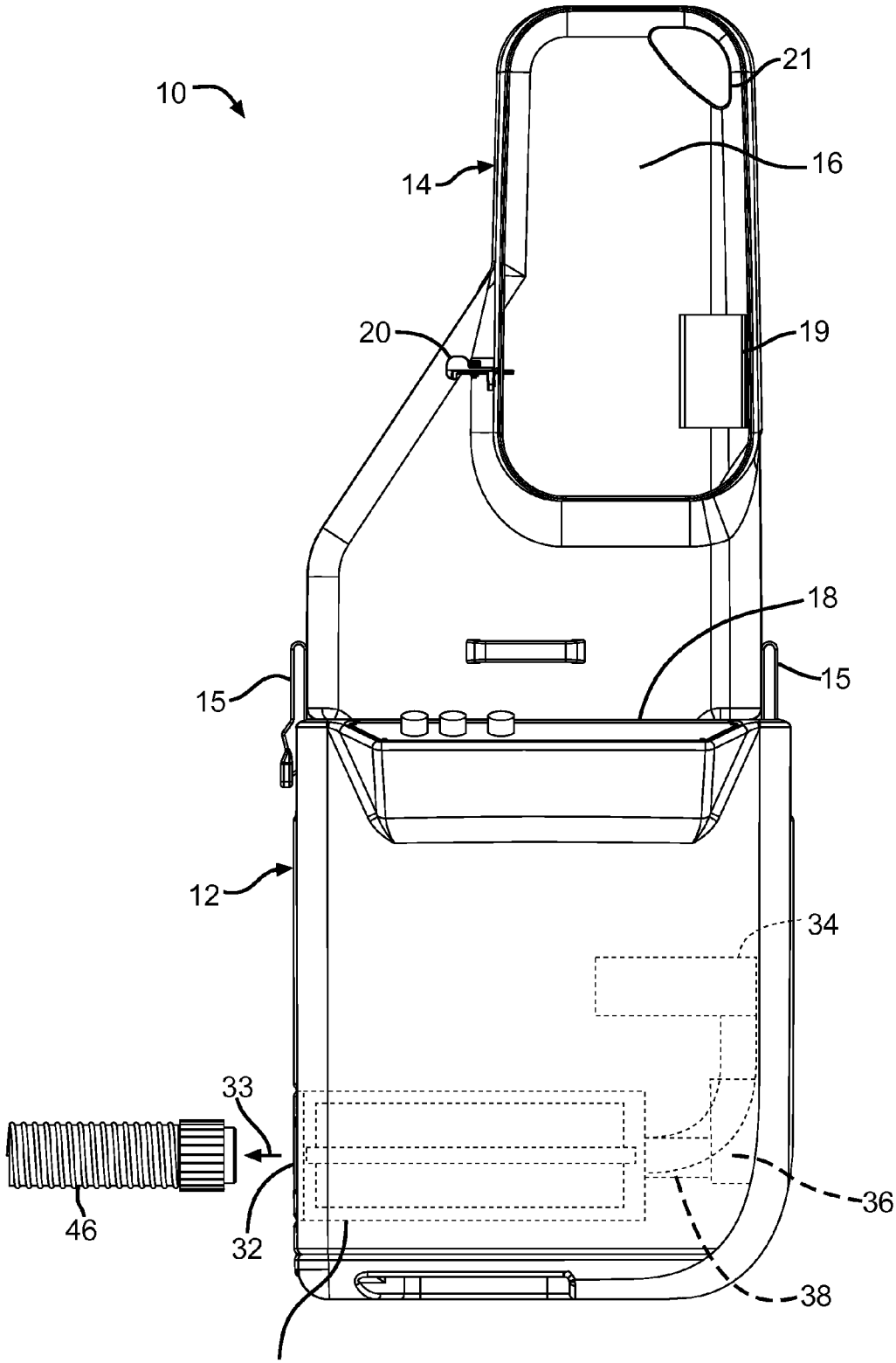
FIG. 3 is a side view in elevation of the loosefill blowing machine of FIG. 1.

A loosefill blowing machine 10, configured for distributing compressed loosefill insulation, is shown in FIGS. 1-3. The loosefill blowing machine 10 includes a lower unit 12 and a chute 14. The lower unit 12 can be connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive compressed loosefill insulation and introduce the loosefill insulation to a shredding chamber 23 as shown in FIG. 2. Optionally, the chute 14 can include a handle segment 21, as shown in FIG. 3, to facilitate easy movement of the blowing insulation machine 10 from one location to another. However, the handle segment 21 is not necessary to the operation of the loosefill blowing machine 10.

As further shown in FIGS. 1-3, the chute 14 can include an optional guide assembly 19 mounted at the inlet end 16 of the chute 14. The guide assembly 19 is configured to urge a package of compressed loosefill insulation against an optional cutting mechanism 20, as shown in FIGS. 1 and 3, as the package moves into the chute 14.

As shown in FIG. 2, the shredding chamber 23 is mounted at the outlet end 18 of the chute 14. In the illustrated embodiment, the shredding chamber 23 includes a plurality of low speed shredders 24*a* and 24*b* and an agitator 26. The low speed shredders, 24*a* and 24*b*, are configured to shred and pick apart the loosefill insulation as the loosefill insulation is discharged from the outlet end 18 of the chute 14 into the lower unit 12. Although the loosefill blowing machine 10 is shown with a plurality of low speed shredders, 24*a* and 24*b*, any type of separator, such as a clump breaker, beater bar or any other mechanism that shreds and picks apart the loosefill insulation can be used.

Referring again to FIG. 2, the agitator 26 is configured to finely condition the loosefill insulation for distribution into an airstream. In the illustrated embodiment, the agitator 26 is positioned beneath the low speed shredders 24*a* and 24*b*. In other embodiments, the agitator 26 can be positioned in any desired location relative to the low speed shredders, 24*a* and 24*b*, sufficient to receive the loosefill insulation from the low speed shredders, 24*a* and 24*b*, including the non-limiting example of horizontally adjacent to the shredders, 24*a* and 24*b*. In the illustrated embodiment, the agitator 26 is a high speed shredder. Alternatively, any type of shredder can be used, such as a low speed shredder, clump breaker, beater bar or any other mechanism configured to finely condition the loosefill insulation and prepare the loosefill insulation for distribution into an airstream.

In the embodiment illustrated in FIG. 2, the low speed shredders, 24*a* and 24*b*, rotate at a lower speed than the agitator 26. The low speed shredders, 24*a* and 24*b*, rotate at a speed of about 40-80 rpm and the agitator 26 rotates at a speed of about 300-500 rpm. In other embodiments, the low speed shredders, 24*a* and 24*b*, can rotate at a speed less than or more than 40-80 rpm, provided the speed is sufficient to shred and pick apart the loosefill insulation. The agitator 26 can rotate at a speed less than or more than 300-500 rpm provided the speed is sufficient to finely condition the loosefill insulation and prepare the loosefill insulation for distribution into an airstream.

Referring again to FIG. 2, a discharge mechanism 28 is positioned adjacent to the agitator 26 and is configured to distribute the finely conditioned loosefill insulation in an airstream. In this embodiment, the finely conditioned loosefill insulation is driven through the discharge mechanism 28 and through a machine outlet 32 by an airstream provided by a blower 36 mounted in the lower unit 12. The airstream is indicated by an arrow 33 as shown in FIG. 3. In other embodiments, the airstream 33 can be provided by other methods, such as by a vacuum, sufficient to provide an airstream 33 driven through the discharge mechanism 28. In the illustrated embodiment, the blower 36 provides the airstream 33 to the discharge mechanism 28 through a duct 38, shown in phantom in FIG. 2 from the blower 36 to the discharge mechanism 28. Alternatively, the airstream 33 can be provided to the discharge mechanism 28 by other structures, devices or mechanisms, including the non-limiting examples of a hose or pipe, sufficient to provide the discharge mechanism 28 with the airstream 33.

The shredders, 24*a* and 24*b*, agitator 26, discharge mechanism 28 and the blower 36 are mounted for rotation and driven by a motor 34. The mechanisms and systems for driving the shredders, 24*a* and 24*b*, agitator 26, discharge mechanism 28 and the blower 36 will discussed in more detail below.

In operation, the chute 14 guides the loosefill insulation to the shredding chamber 23. The shredding chamber 23 includes the low speed shredders, 24*a* and 24*b*, configured to shred and pick apart the loosefill insulation. The shredded loosefill insulation drops from the low speed shredders, 24*a* and 24*b*, into the agitator 26. The agitator 26 finely conditions the loosefill insulation for distribution into the airstream 33 by further shredding the loosefill insulation. The finely conditioned loosefill insulation exits the agitator 26 and enters the discharge mechanism 28 for distribution into the airstream 33 caused by the blower 36. The airstream 33, with the finely conditioned loosefill insulation, exits the machine 10 at a machine outlet 32 and flows through a distribution hose 46, as shown in FIG. 3, toward the insulation cavity, not shown.

Referring again to FIG. 2, the discharge mechanism 28 is configured to distribute the finely conditioned loosefill insulation into the airstream 33. In the illustrated embodiment, the discharge mechanism 28 is a rotary valve. Alternatively, the discharge mechanism 28 can be other mechanisms including staging hoppers, metering devices, or rotary feeders, sufficient to distribute the finely conditioned loosefill insulation into the airstream 33.

Referring again to FIG. 2, the low speed shredders, 24*a* and 24*b*, rotate in a counter-clockwise direction r1 (as shown in FIG. 2) and the agitator 26 rotates in a counter-clockwise direction r2 (also shown in FIG. 2). Rotating the low speed shredders, 24*a* and 24*b*, and the agitator 26 in the same counter-clockwise direction allows the low speed shredders, 24*a* and 24*b*, and the agitator 26 to shred and pick apart the loosefill insulation while substantially preventing an accumulation of unshredded or partially shredded loosefill insulation in the shredding chamber 23. In other embodiments, the low speed shredders, 24*a* and 24*b*, and the agitator 26 each could rotate in a clock-wise direction or the low speed shredders, 24*a* and 24*b*, and the agitator 26 could rotate in different directions provided the relative rotational directions allow finely conditioned loosefill insulation to be fed into the discharge mechanism 28 while preventing a substantial accumulation of unshredded or partially shredded loosefill insulation in the shredding chamber 23.

Referring again to FIG. 2, the discharge mechanism 28 has a side inlet 47. The side inlet 47 is configured to receive the finely conditioned loosefill insulation as it is fed from the agitator 26. In the illustrated embodiment, the agitator 26 is positioned to be adjacent to the side inlet 47 of the discharge mechanism 28. In other embodiments, a low speed shredder 24, or a plurality of shredders 24 or agitators 26, or other shredding mechanisms can be adjacent to the side inlet 47 of the discharge mechanism or in other suitable positions.

As shown in FIG. 2, an optional choke 48 can be positioned between the agitator 26 and the discharge mechanism 28. The choke 48 is configured to redirect heavier clumps of loosefill insulation past the side inlet 47 of the discharge mechanism 28 and back to the low speed shredders, 24*a* and 24*b*, for further conditioning. The cross-sectional shape and height of the choke 47 can be configured to control the conditioning properties of the loosefill insulation entering the side inlet 47 of the discharge mechanism 28. While the illustrated embodiment of the choke 48 is shown as having a triangular cross-sectional shape, it should be appreciated that the choke 48 can have any cross-sectional shape and height sufficient to achieve the desired conditioning properties of the loosefill insulation entering the side inlet 47 of the discharge mechanism 28.

Figure 4:
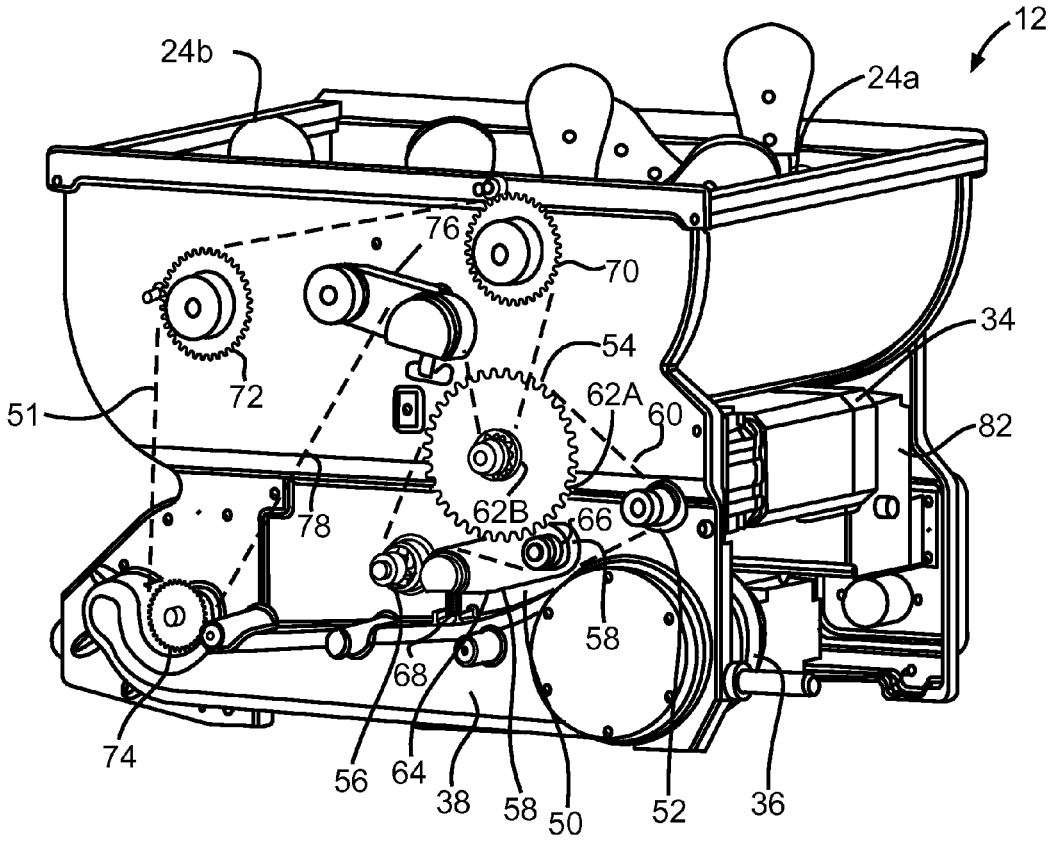
FIG. 4 is a perspective view of the lower unit of the blowing insulation machine of FIG. 1 illustrating first and second drive systems.

Referring now to FIG. 4, a portion of the lower unit 12 is illustrated. As discussed above, the lower unit 12 includes the blower 36, the duct 38 extending from the blower 36 to the discharge mechanism (not shown), the motor 34, the low speed shredders, 24*a* and 24*b* and the agitator (not shown). The lower unit 12 also includes a first drive system 50 and a second drive system 51. Generally, the first drive system 50 is configured to drive the agitator (not shown) and also configured to drive the second drive system 51. The second drive system 51 is configured to drive the low speed shredders, 24*a* and 24*b*, and the discharge mechanism 28.

Referring again to FIG. 4, the first drive system 50 includes a motor drive sprocket 52, an idler 54, an agitator sprocket 56 and a tension mechanism 58. The first drive system 50 also includes a first drive chain 60, configured to cause rotation of the idler 54, agitator sprocket 56 and tension mechanism 58. The motor drive sprocket 52 is connected to and is rotated by the motor 34. The idler 54 includes first and second sprockets, 62*a* and 62*b*. The idler 54 is configured such that rotation of the first sprocket 62*a* by the first drive chain 60 results in rotation of the second sprocket 62*b*. As will be explained in more detail below, the second sprocket 62*b* is included in the second drive system 51. The agitator sprocket 56 is connected to the agitator (not shown) such that rotation of the agitator sprocket 56 causes agitator to rotate. The tension mechanism 58 is configured to maintain a desired level of tension in the first drive chain 60. The tension mechanism 58 includes a rotatable arm 64 having an idler wheel 66 and thrust mechanism 68. Generally, the thrust mechanism 68 is configured to urge the rotatable arm 64 in an vertically upward direction while pivoting about the idler wheel 66, such as to cause tension in the first drive chain 60. While the embodiment of the tension mechanism 58 illustrated in FIG. 4 includes the rotatable arm 64, idler wheel 66 and thrust mechanism 68, it should be appreciated that in other embodiments of the lower unit 12, the tension mechanism 58 can include other structures, mechanisms and devices sufficient to maintain a desired level of tension in the first drive chain 60. In still other embodiments, the tension in the first drive chain 60 can be maintained without a tension mechanism.

In operation, the motor 34 causes the motor drive sprocket 52 is rotate. Rotation of the motor drive sprocket 52 causes movement of the first drive chain 60. Movement of the first drive chain 60 causes rotation of the first sprocket 62*a* of the idler 54 and also causes rotation of the agitator sprocket 56. Rotation of the agitator sprocket 56 causes rotation of the agitator.

Referring again to FIG. 4, the second drive system 51 includes the second sprocket 62*b* of the idler 54, a first low speed shredder sprocket 70, a second low speed shredder sprocket 72, a discharge mechanism sprocket 74 and a tension mechanism 76. The second drive system 51 also includes a second drive chain 78, configured to cause rotation of the first low speed shredder sprocket 70, the second low speed shredder sprocket 72 and the discharge mechanism sprocket 74. The first low speed shredder sprocket 70 is connected to the first low speed shredder 24*a* such that rotation of the first low speed shredder sprocket 70 causes rotation of the first low speed shredder 24*a*. In a similar manner, the second low speed shredder sprocket 72 is connected to the second low speed shredder 24*b* such that rotation of the second low speed shredder sprocket 72 causes rotation of the second low speed shredder 24*b*. The discharge mechanism sprocket 74 is connected to the discharge mechanism such that rotation of the discharge mechanism sprocket 74 causes rotation of the discharge mechanism. In the illustrated embodiment, the second tension mechanism 76 is the same as, or similar to, the first tension mechanism 58 discussed above. In other embodiments, the second tension mechanism 76 can be different from the first tension mechanism 58.

As discussed above, rotation of the first sprocket 62*a* by the first drive chain 60 results in rotation of the second sprocket 62*b*. Rotation of the second sprocket 62*b* results in movement of the second drive chain 78. Movement of the second drive chain 78 causes rotation of the first low speed shredder sprocket 70, the second low speed shredder sprocket 72 and the discharge mechanism sprocket 74. Rotation of the agitator sprocket 56 causes rotation of the agitator.

In the embodiment illustrated in FIG. 4, the first and second drive systems, 50 and 51, are configured such that the motor 34 drives each of the shredders, 24*a* and 24*b*, the agitator 26 and the discharge mechanism 28. In other embodiments, each of the shredders, 24*a* and 24*b*, the agitator 26 and the discharge mechanism 28 can be provided with its own motor.

In the illustrated embodiment, the motor 34 driving the first and second drive systems (50, 51) is configured to operate on a single 15 ampere, 110 volt a.c. power supply. In other embodiments, other power supplies an be used.

Referring again to FIGS. 2 and 4 and as discussed above, the blower 36 provides the airstream to the discharge mechanism 28 through the duct 38 connecting the blower 36 to the discharge mechanism 28. In the illustrated embodiment, the blower 36 is a commercially available component, such as the non-limiting example of model 119419-00 manufactured by Ametek, Inc., headquartered in Paoli, Pa., although other blowers can be used.

Referring again to FIG. 4, the motor 34, configured to drive the first and second drive systems, 50 and 51, is controlled by a first controller 82. The first controller 82 is configured to control the rotational speed of the motor 34 such that the resulting rotational speed of the low speed shredders, 24*a* and 24*b*, the agitator 26 and the discharge mechanism 28 can vary within a desired rotational speed range. In the illustrated embodiment, the first controller 82 is a variable frequency drive configured to control the rotational speed of the motor 34 by controlling the frequency of the electrical power supplied to the motor 34. In certain embodiments, the variable frequency drive 82 is a commercially available component. Alternatively, the variable frequency drive 82 can be any structure, device or mechanism sufficient to control the rotational speed of the motor 34 by controlling the frequency of the electrical power supplied to the motor 34. As the frequency of the power supplied to the motor 34 is varied, the resulting speed of the motor 34 is varied, resulting a variable rotational speed of the low speed shredders, 24*a* and 24*b*, the agitator 26 and the discharge mechanism 28. While the illustrated embodiment has been described as using a variable frequency drive 82 to control the motor 34, it should be understood that in other embodiments, the motor 34 can be controlled by other devices or other control methodologies, including the non-limiting example of a variable voltage variable frequency drive. As a result of varying the rotation speed of the low speed shredders, 24*a* and 24*b*, the agitator 26 and the discharge mechanism 28, the flow rate of the conditioned loosefill insulation through the loosefill blowing machine 10 can be varied. As will be discussed in more detail below, the flow rate of the loosefill insulation through the loosefill blowing machine 10 can be varied depending on certain operating parameters, including the non-limiting example of pressure exerted on the finely conditioned loosefill insulation as it exits the machine 10.

Referring again to FIG. 4, the blower 36, configured to provide the airstream 33 to the discharge mechanism 28 through a duct 38, is controlled by a second controller (not shown). The second controller is configured to modulate the operation of the blower 36 such that the resulting flow rate of the airstream from the blower 36 to the discharge mechanism 28 can vary within a desired flow rate range. In certain embodiments, the second controller is a microprocessor-based mechanism and the control methodology utilized by the microprocessor-based mechanism is a pulse width modulation. The term "pulse width modulation", as used herein, is defined to mean a variable-power scheme that switches the supplied power quickly between fully on and fully off for defined periods of time. As the power supplied to the blower 36 is modulated, the resulting speed of the blower 36 can be varied, thereby resulting a variable flow rate of the airstream 33 from the blower 36 to the discharge mechanism 28. While the aforementioned embodiment has been described as using a microprocessor-based mechanism incorporating pulse width modulation to control the blower 36, it should be understood that in other embodiments, the blower 36 can be controlled by other devices using other control methodologies. As will be discussed in more detail below, it is desirable to vary the flow rate of the airstream 33 from the blower 36 to the discharge mechanism 28 depending on certain operating parameters, including the non-limiting example of pressure exerted on the finely conditioned loosefill insulation as it exits the machine 10.

Figure 5:
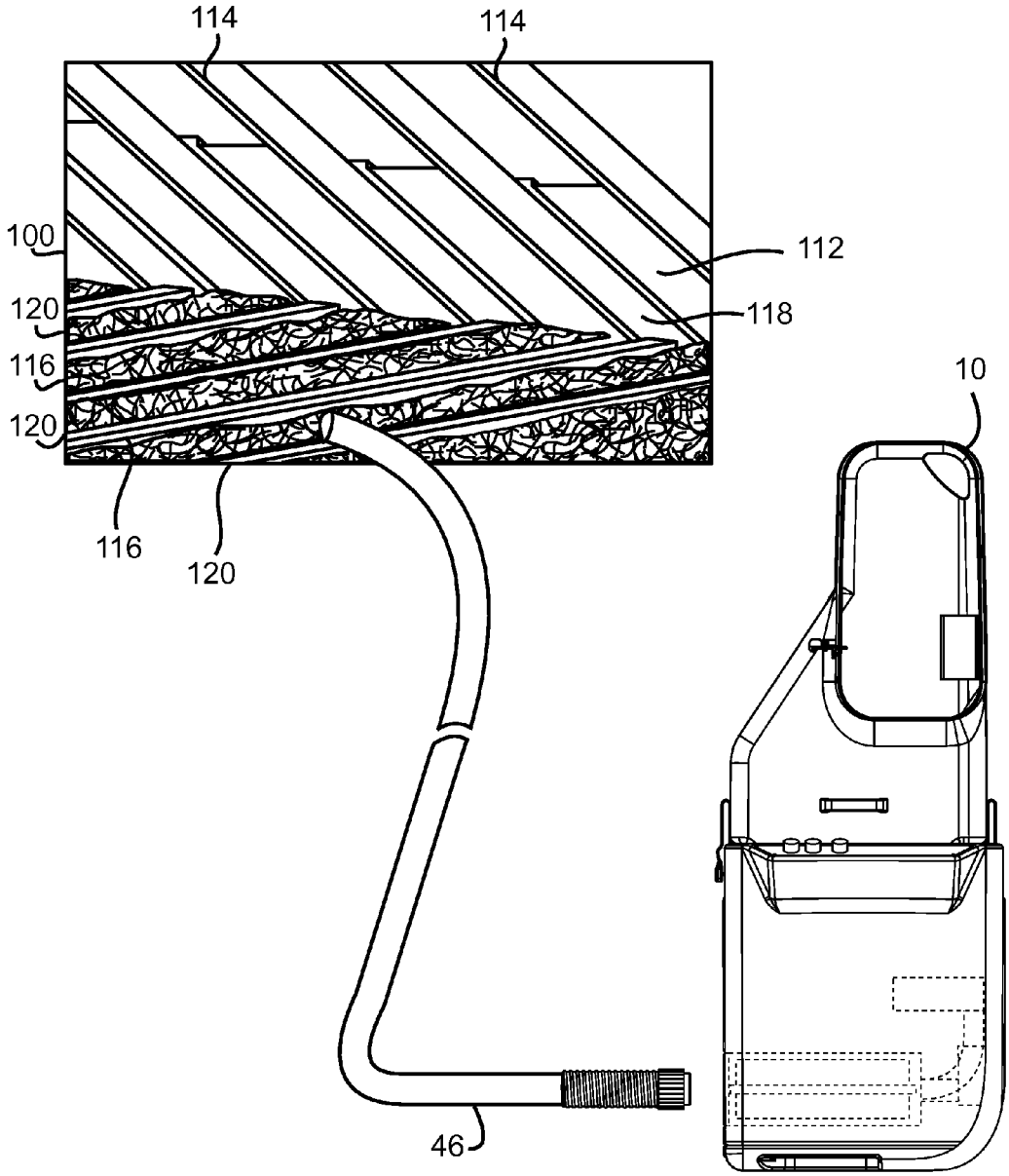
FIG. 5 is a schematic view of a blowing insulation machine configured to distribute loosefill insulation into insulation cavities of a building.

Referring now to FIG. 5, a first embodiment of an application of the loosefill blowing machine 10 is illustrated. In this embodiment, the loosefill blowing machine 10 is used to insulate an attic space 118 within the building 100. The building 100 includes a roof deck 112 supported by a plurality of rafters 114 and an internal ceiling (not shown) supported by a plurality of framing members 116. An attic space 118 is formed internal to the building 100 and defined by the roof deck 112 and the framing members 116. Insulation cavities 120 are formed between the plurality of framing members 116. The insulation cavities 120 can be filled with loosefill insulation 122.

Referring again to FIG. 5, the loosefill blowing machine 10 is configured to distribute the finely conditioned loosefill insulation into the insulation cavities 120 through the distribution hose 46. In operation, the finely conditioned loosefill insulation is blown into the insulation cavities 120 and allowed to settle. As the finely conditioned loosefill insulation exits the distribution hose 46, the loosefill insulation encounters a pressure. In the embodiment illustrated in FIG. 5, the pressure exerted on the loosefill insulation is merely atmospheric air pressure.

Figure 6:
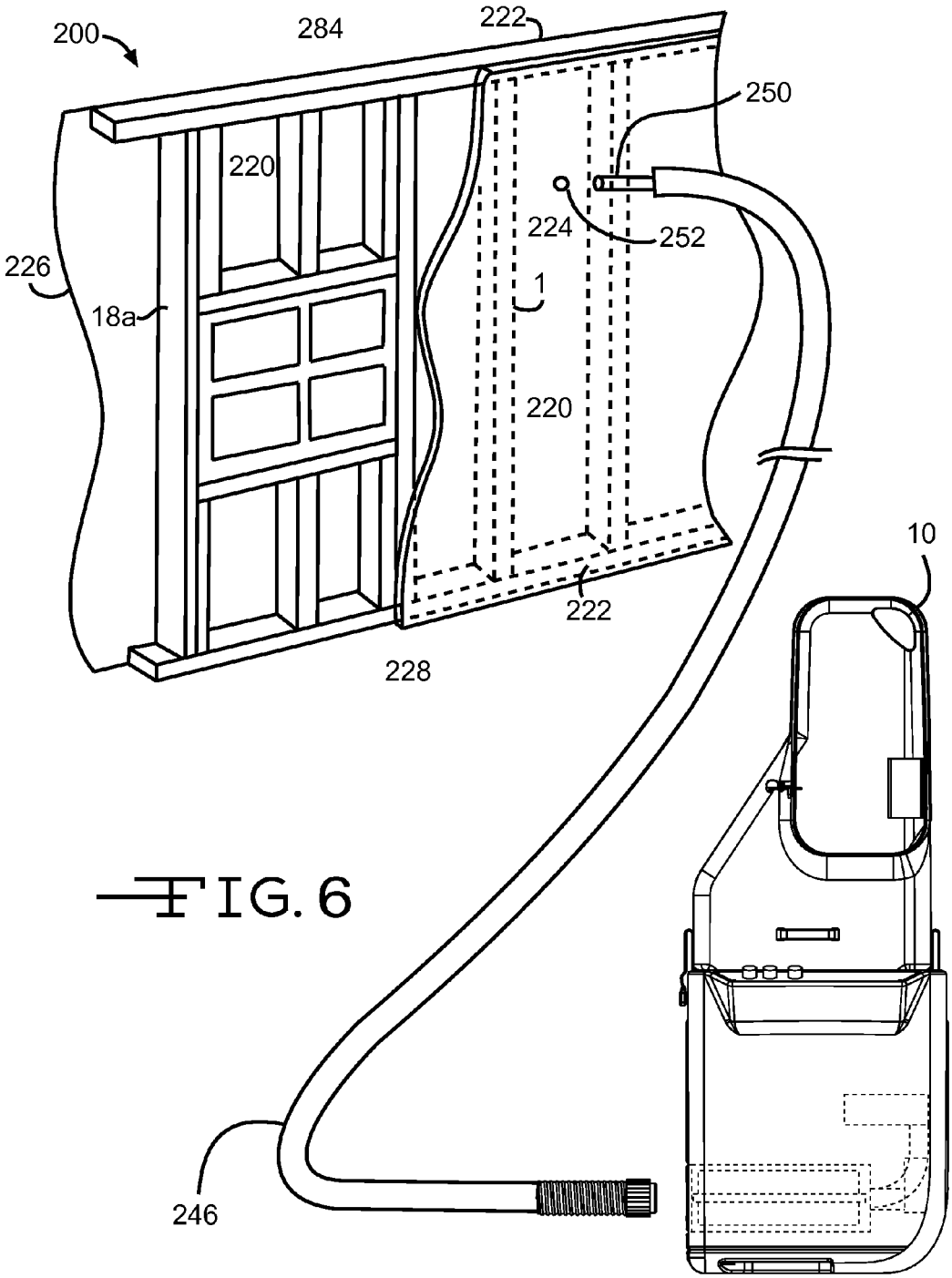
FIG. 6 is a schematic view of a second embodiment of a blowing insulation machine configured to distribute loosefill insulation into insulation cavities of a building.

In other embodiments as shown in FIG. 6, the loosefill blowing machine 10 is configured to distribute finely conditioned loosefill insulation into tight or cramped spaces, such as for example, insulation cavities 220 formed within an existing building 200. In the portion of the existing building 200 illustrated in FIG. 6, the insulation cavities 220 are formed within existing sidewalls 284 and defined by plates 222, framing members 224, exterior sheathing 226 and internal covering material 228. In other embodiments, the insulation cavities 220 can be formed by other structural components and can have any size, shape or configuration.

Referring again to FIG. 6, distribution hose 246 includes a nozzle 250. The nozzle 250 has a diameter than generally corresponds to the diameter of an aperture 252 formed in the internal covering material 228. In the illustrated embodiment, the nozzle has a diameter that is less than the diameter of the distribution hose 246. Alternatively, the nozzle 250 can have a diameter that is equal to or larger than the diameter of the distribution hose 246. In operation, the nozzle 250 is inserted into the aperture 252 and the loosefill insulation is blown through the aperture 252 and into the insulation cavity 220 by the loosefill blowing machine 10. As the finely conditioned loosefill insulation exits the nozzle 250 and is distributed within the insulation cavity 220, the loosefill insulation can encounter a back pressure formed within the insulation cavity 220 by the inrushing airstream and the entrained loosefill insulation. In certain embodiments, the back pressure exerted on the loosefill insulation exiting the nozzle 250 can clog the nozzle 250 or prevent a uniform flow of the loosefill insulation from exiting the nozzle 250. Without being held to the theory, it is believed the clogging of the nozzle 250 can result from two independent problems. First, the flow rate of the loosefill insulation through the distribution hose 246 can exceed the capability of the loosefill insulation to compress and pass through the reduced diameter of the nozzle 250. Second, the flow rate of the airstream 33 can exceed the ability of tight or cramped spaces to dissipate the airstream. This results in high back pressure in the distribution hose 246 which can stop or retard the flow of the airstream 33 and result in a clog or block in the nozzle 250. The high back pressure in the distribution hose 246 can also result in a loosefill blowing machine 10 shut down due to excess power draw to the motor 34.

Accordingly, the blowing insulation machine 10 is adaptable to provide a maximum flow for the airstream 33 and a maximum flow of loosefill insulation when blowing insulation into open spaces. The blowing insulation machine 10 is further adaptable to provide variable flows of the airstream 33 and the loosefill insulation when blowing insulation into tight or cramped spaces. In the embodiment illustrated in FIG. 5 showing blowing insulation into open spaces where little or no back pressure is anticipated, the motor 34 and the blower 36 can be operated at 100% of the rated rotational speeds. At the 100% level, the blower 36 provides an airstream 33 in a range of from about 2.5 cubic feet per minute (cfm) to about 4.5 cfm at a pressure of 0.98 pounds per square inch (psi). At the 100% level, the motor 34 rotates the low speed shredders, 24*a* and 24*b*, the agitator 26 and the discharge mechanism 28 such as to provide a loosefill flow rate in a range of from about 6.0 pounds per minute (lbs/min) to about 8.5 lbs/min. In other embodiments, such as for example the embodiment illustrated in FIG. 6, where significant back pressure may be exerted on the loosefill insulation exiting the nozzle 250, the flow rate of the airstream 33 provided by the blower 36 and the flow rate of the loosefill insulation provided by the motor 34 can be varied. In one non-limiting example of reducing the flow rate of the airstream 33 and the flow rate of the loosefill insulation, the motor 34 and the blower 36 can be operated at 70% of the rated rotation speeds. At the 70% level, the blower 36 provides an airstream 33 in a range of from about 2.0 cfm to about 4.0 cfm at a pressure of 0.89 psi. At the 70% level, the motor 34 rotates the low speed shredders, 24*a* and 24*b*, the agitator 26 and the discharge mechanism 28 such as to provide a loosefill flow rate in a range of from about 4.0 lbs/min. to about 6.0 lbs/min. While the aforementioned examples are described at operating levels of 70% and 100%, it should be appreciated that the loosefill blowing machine 10 can be practiced at other operating levels.

The principle and methods of assembly of the insulation blowing machine have been described in its preferred embodiments. However, it should be noted that the insulation blowing machine may be practiced otherwise than as specifically illustrated and described without departing from its scope.

What is claimed is:

1. A machine for distributing loosefill insulation from a source of compressed loosefill insulation, the machine being configured to discharge the loosefill insulation into distribution hoses, the machine comprising:

a shredding chamber having an outlet end and a plurality of shredders configured to condition the loosefill insulation, the plurality of shredders configured to operate at variable rotational speeds; and a discharge mechanism mounted at the outlet end of the shredding chamber, the discharge mechanism configured for distributing the conditioned loosefill insulation from a machine outlet in an airstream provided by a blower, the blower configured to operate at variable rotational speeds;

wherein the plurality of shredders, the discharge mechanism and the blower are configured to operate on a single 15 ampere, 110 volt a.c. power supply; and wherein the variable rotational speeds of the plurality of shredders are configured to provide variable flow rates of the loosefill insulation and the variable rotational speeds of the blower are configured to provide variable flow rates of the airstream.

2. The machine of claim 1, wherein the plurality of shredders include low speed shredders and an agitator.

3. The machine of claim 2, wherein the low speed shredders and the discharge mechanism are driven by a first drive system and the agitator is driven by a second drive system.

4. The machine of claim 1, wherein a motor is configured to drive the plurality of shredders and the discharge mechanism, and wherein the motor is controlled by a variable frequency drive system.

5. The machine of claim 1, wherein the variable rotational speed of the blower is controlled by pulse width modulation.

6. The machine of claim 1, wherein at an operating level of 100% of the rated rotational speed of the motor and blower, the blower provides an airstream in a range of from about 2.5 cubic feet per minute to about 4.5 cubic feet per minute, and the motor rotates the plurality of shredders such as to provide a loosefill flow rate in a range of from about 6.0 pounds per minute to about 8.5 pounds per minute.

7. The machine of claim 1, wherein at an operating level of 70% of the rated rotational speed of the motor and blower, the blower provides an airstream in a range of from about 2.0 cubic feet per minute to about 4.0 cubic feet per minute, and the motor rotates the plurality of shredders such as to provide a loosefill flow rate in a range of from about 4.0 pounds per minute to about 6.0 pounds per minute.

8. A machine for distributing loosefill insulation from a source of compressed loosefill insulation, the machine being configured to discharge the loosefill insulation into distribution hoses, the machine comprising:

an upper unit having an inlet and an outlet, the inlet configured to receive the compressed loosefill insulation;

a lower unit having an inlet connected to the outlet of the upper unit, the lower unit further including a shredding chamber, a discharge mechanism, a blower and a motor, the shredding chamber having a plurality of shredders configured to condition the loosefill insulation, the plurality of shredders configured to operate at variable rotational speeds, the discharge mechanism configured for distributing the conditioned loosefill insulation from a machine outlet in an airstream provided by the blower, the blower configured to operate at variable rotational speeds, the plurality of shredders, the discharge mechanism and the blower being driven by the motor configured to operate on a single 15 ampere, 110 volt a.c. power supply;

wherein the variable rotational speeds of the plurality of shredders are configured to provide variable flow rates of the loosefill insulation and the variable rotational speeds of the blower are configured to provide variable flow rates of the airstream.

9. The machine of claim 8, wherein the plurality of shredders include low speed shredders and an agitator.

10. The machine of claim 9, wherein the low speed shredders and the discharge mechanism are driven by a first drive system and the agitator is driven by a second drive system.

11. The machine of claim 8, wherein the motor is controlled by a variable frequency drive system.

12. The machine of claim 8, wherein the variable rotational speed of the blower is controlled by pulse width modulation.

13. The machine of claim 8, wherein at an operating level of 100% of the rated rotational speed of the motor and blower, the blower provides an airstream in a range of from about 2.5 cubic feet per minute to about 4.5 cubic feet per minute, and the motor rotates the plurality of shredders such as to provide a loosefill flow rate in a range of from about 6.0 pounds per minute to about 8.5 pounds per minute.

14. The machine of claim 8, wherein at an operating level of 70% of the rated rotational speed of the motor and blower, the blower provides an airstream in a range of from about 2.0 cubic feet per minute to about 4.0 cubic feet per minute, and the motor rotates the plurality of shredders such as to provide a loosefill flow rate in a range of from about 4.0 pounds per minute to about 6.0 pounds per minute.

15. A method of distributing loosefill insulation from a machine for distributing loosefill insulation from a package of compressed loosefill insulation, the method comprising the steps of:

providing a shredding chamber having an outlet end and a plurality of shredders configured to condition the loosefill insulation, the plurality of shredders configured to operate at variable rotational speeds;

providing a discharge mechanism mounted at the outlet end of the shredding chamber, the discharge mechanism configured for distributing the conditioned loosefill insulation from a machine outlet in an airstream provided by a blower, the blower configured to operate at variable rotational speeds;

operating the plurality of shredders, the discharge mechanism and the blower on a single 15 ampere, 110 volt a.c. power supply;

varying the rotational speed of the plurality of shredders such as to provide variable flow rates of the loosefill insulation; and varying the rotational speed of the blower such as to provide variable flow rates of the airstream.

16. The method of claim 15, wherein the plurality of shredders include low speed shredders and an agitator, and wherein the low speed shredders and the discharge mechanism are driven by a first drive system and the agitator is driven by a second drive system.

17. The method of claim 15, wherein the motor is controlled by a variable frequency drive system.

18. The method of claim 15, wherein the variable rotational speed of the blower is controlled by pulse width modulation.

19. The method of claim 15, wherein at an operating level of 100% of the rated rotational speed of the motor and the blower, the blower provides an airstream in a range of from about 2.5 cubic feet per minute to about 4.5 cubic feet per minute, and the motor rotates the plurality of shredders such as to provide a loosefill flow rate in a range of from about 6.0 pounds per minute to about 8.5 pounds per minute.

20. The method of claim 15, wherein at an operating level of 70% of the rated rotational speed of the motor and the blower, the blower provides an airstream in a range of from about 2.0 cubic feet per minute to about 4.0 cubic feet per minute, and the motor rotates the plurality of shredders such as to provide a loosefill flow rate in a range of from about 4.0 pounds per minute to about 6.0 pounds per minute.

* * * * *